US008944566B2

(12) United States Patent
Kang et al.

(10) Patent No.: US 8,944,566 B2
(45) Date of Patent: Feb. 3, 2015

(54) INKJET PRINT HEAD

(71) Applicant: Samsung Electro-Mechanics Co., Ltd., Suwon (KR)

(72) Inventors: Pil Joong Kang, Suwon (KR); Yoon Sok Park, Suwon (KR); Hwa Sun Lee, Suwon (KR); Seung Joo Shin, Suwon (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 13/717,945

(22) Filed: Dec. 18, 2012

(65) Prior Publication Data

US 2013/0208050 A1 Aug. 15, 2013

(30) Foreign Application Priority Data

Feb. 14, 2012 (KR) ..... 10-2012-0014567

(51) Int. Cl.
*B41J 2/14* (2006.01)
*B41J 2/16* (2006.01)
*B41J 2/045* (2006.01)

(52) U.S. Cl.
CPC ..... *B41J 2/04541* (2013.01); *B41J 2/14233* (2013.01); *B41J 2002/14491* (2013.01)
USPC ..... 347/50

(58) Field of Classification Search
CPC .... B41J 2/3358; B41J 2/1408; B41J 2/14153; B41J 2/3352; B41J 2/255; B41J 2/26; B41J 2/04541
USPC ..... 347/50, 57, 58, 59
See application file for complete search history.

(56) References Cited

U.S. PATENT DOCUMENTS

| | | | | |
|---|---|---|---|---|
| 5,197,892 | A * | 3/1993 | Yoshizawa et al. | 439/91 |
| 6,123,410 | A | 9/2000 | Beerling et al. | |
| 7,413,291 | B2 * | 8/2008 | Ito | 347/71 |
| 2003/0117464 | A1 | 6/2003 | Miyata | |
| 2003/0206218 | A1 * | 11/2003 | Miyata et al. | 347/70 |
| 2003/0218657 | A1 | 11/2003 | Miyata | |
| 2011/0018942 | A1 | 1/2011 | Suzuki et al. | |
| 2011/0254900 | A1 | 10/2011 | Kang et al. | |

FOREIGN PATENT DOCUMENTS

| | | |
|---|---|---|
| JP | 11-192705 | 7/1999 |
| JP | 2003-246065 | 9/2003 |
| JP | 2004-1366 | 1/2004 |
| JP | 2007-030417 | 2/2007 |

(Continued)

OTHER PUBLICATIONS

Korean Office Action issued May 31, 2013 in corresponding Korean Application No. 10-2012-0014567.

(Continued)

*Primary Examiner* — Stephen Meier
*Assistant Examiner* — Renee I Wilson

(57) ABSTRACT

There is provided an inkjet print head including: an ink discharging unit including a plurality of actuators; a connection substrate disposed on the ink discharging unit and having a first circuit pattern electrically connected to the plurality of actuators; and a switching board having a second circuit pattern connected to the first circuit pattern and including a plurality of driving integrated chips (ICs) controlling the plurality of actuators.

16 Claims, 7 Drawing Sheets

(56) References Cited

FOREIGN PATENT DOCUMENTS

| | | |
|---|---|---|
| JP | 2011-25483 | 2/2011 |
| KR | 10-2011-0115771 | 10/2001 |

OTHER PUBLICATIONS

Office Action issued by the Japanese Patent Office on Jan. 7, 2014 in the corresponding Japanese patent application No. 2012-267645.

* cited by examiner

INKJET PRINT HEAD

CROSS-REFERENCE TO RELATED APPLICATIONS

This application claims the priority of Korean Patent Application No. 10-2012-0014567 filed on Feb. 14, 2012, in the Korean Intellectual Property Office, the disclosure of which is incorporated herein by reference.

BACKGROUND OF THE INVENTION

1. Field of the Invention

The present invention relates to an inkjet print head, and more particularly, to an inkjet print head capable of being miniaturized and performing high resolution printing.

2. Description of the Related Art

An inkjet print head may include a plurality of nozzles in order to achieve high quality printing. For example, the inkjet print head may have a 512 structure (for reference, a 512 structure is an inkjet print head structure in which 512 nozzles are formed in a length direction).

In a 512 structure, since a plurality of nozzles are disposed densely in the length direction of the inkjet print head, relatively high quality printing may be achieved.

Meanwhile, in the 512 structure, an interval between the nozzles (or an interval between actuators) is 280 μm, larger than 200 μm, corresponding to a minimum wiring interval of a flexible substrate. Therefore, in the inkjet print head having the 512 structure, a plurality of actuators and driving integrated chips (ICs) may be easily connected to each other using the flexible substrate.

However, as high resolution printing quality has gradually become necessary, the development of an inkjet print head having a 1024 structure has been required. However, since the 1024 structure is a structure in which 1024 nozzles are densely disposed in a length direction of the inkjet print head, an interval between nozzles is less than that of the 512 structure. Therefore, in an inkjet print head having the 1024 structure, respective actuators and driving ICs may not be connected to each other using the flexible substrate.

As the related art, there are provided Patent Documents 1 and 2. Patent Document 1 discloses a configuration in which a piezoelectric element 300 and a driving IC 130 are connected to each other using a driving wiring 140. However, in order to utilize the configuration disclosed in Patent Document 1 in the inkjet print head having the 1024 structure, the driving IC should be customized. In addition, in the case of Patent Document 1, since a distance between the driving IC 130 and the piezoelectric element 300 is relatively small, the driving IC 130 may malfunction due to heat generated from the piezoelectric element 300.

In contrast, Patent Document 2 discloses a configuration in which a piezoelectric element 300 and a driving circuit 200 are connected to each other using a chip on film (COF) substrate 410. However, in the configuration disclosed in Patent Document 2, since a size of the COF substrate may be increased to match that of the driving circuit 200, it is difficult to miniaturize the inkjet print head. In addition, in Patent Document 2, since the piezoelectric element 300 and the driving circuit 200 are connected to each other by the COF substrate 410, it is difficult to utilize the configuration disclosed in Patent Document 2 in a structure in which an interval between nozzles is small.

RELATED ART DOCUMENT (Patent Document 1) JP2004-001366 A
(Patent Document 2) JP2011-025483 A

SUMMARY OF THE INVENTION

An aspect of the present invention provides an inkjet print head appropriate for a 1024 structure.

According to an aspect of the present invention, there is provided an inkjet print head including: an ink discharging unit including a plurality of actuators; a connection substrate disposed on the ink discharging unit and having a first circuit pattern electrically connected to the plurality of actuators; and a switching board having a second circuit pattern connected to the first circuit pattern and including a plurality of driving integrated chips (ICs) controlling the plurality of actuators.

The plurality of actuators may be connected to the first circuit pattern by wires.

The connection substrate may include a plurality of through-holes into which a plurality of wires connecting the plurality of actuators and the first circuit pattern to each other are inserted, respectively.

The connection substrate may have a disposition space in which the plurality of actuators are disposed.

The plurality of driving ICs may be obliquely disposed with respect to a length direction of the switching board.

The first circuit pattern may include a plurality of first connection pads and a plurality of second connection pads.

The second connection pads adjacent to each other may be alternately disposed.

The switching board may include third connection pads connected to the second connection pads.

The inkjet print head may further include a cooling unit formed in the connection substrate and cooling the switching board.

According to another aspect of the present invention, there is provided an inkjet print head including: an ink discharging unit including a plurality of actuators arranged in two rows; a connection substrate disposed on the ink discharging unit and having a first circuit pattern electrically connected to the plurality of actuators; an ink supplying unit disposed at a center of the connection substrate; and a pair of switching boards having a second circuit pattern connected to the first circuit pattern, including a plurality of driving ICs controlling the plurality of actuators, and disposed to be symmetrical to each other, based on the ink supplying unit.

The plurality of actuators may be connected to the first circuit pattern by wires.

The connection substrate may include a plurality of through-holes into which a plurality of wires connecting the plurality of actuators and the first circuit pattern to each other are inserted, respectively.

The connection substrate may have a disposition space in which the plurality of actuators are disposed.

The plurality of driving ICs may be obliquely disposed with respect to a length direction of the switching board.

The first circuit pattern may include a plurality of first connection pads and a plurality of second connection pads.

The second connection pads adjacent to each other may be alternately disposed.

The switching board may include third connection pads connected to the second connection pads.

The inkjet print head may further include a cooling unit formed in the connection substrate and cooling the switching board.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
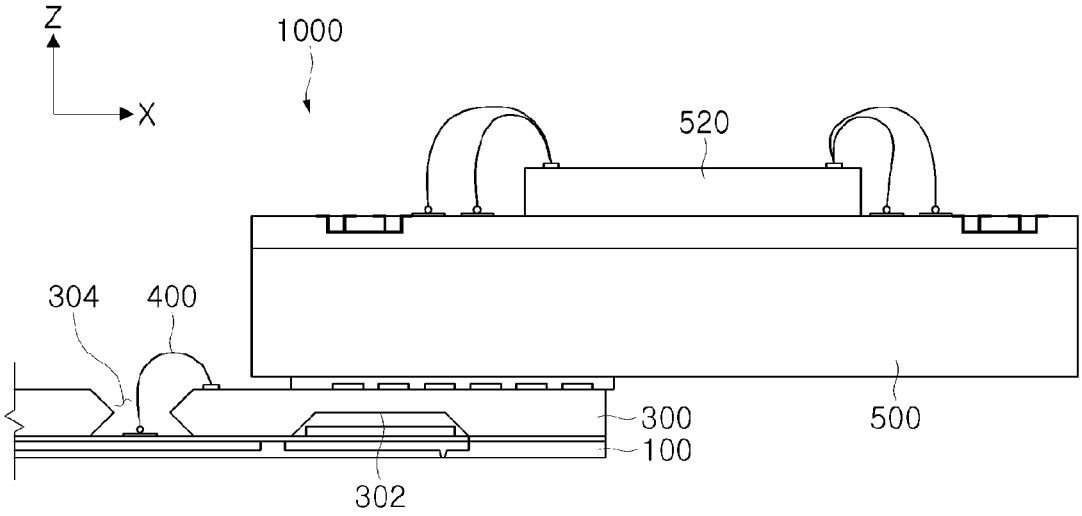
FIG. 1 is a cross-sectional view of an inkjet print head according to an embodiment of the present invention.

Terms used in the present specification will be first defined as follows.

In the present specification, a 512 structure indicates an inkjet print head having 512 nozzles disposed in a length direction thereof, while a 1024 structure indicates an inkjet print head having 1024 nozzles disposed in a length direction thereof.

As high resolution printing quality has become necessary, an interval between nozzles in an ink head has gradually decreased.

Inkjet print heads have recently been changed from the 512 structure into the 1024 structure.

However, the following limitations in manufacturing the inkjet print head having the 1024 structure may exist.

First, it may be difficult to connect an actuator and a driving integrated chip (IC) to each other.

In an inkjet print head having the 512 structure, an interval between actuators is 280 μm or more, larger than 200 μm, corresponding to a minimum wiring interval of a flexible substrate. Therefore, in the inkjet print head having the 512 structure, it is easy to connect the actuator and the driving IC to each other using the flexible substrate.

However, in an inkjet print head having the 1024 structure, since an interval between actuators is 200 μm or less, smaller than a minimum wiring interval of the flexible substrate, it is not easy to connect a plurality of actuators and driving ICs that are disposed densely with regard to each other.

Second, manufacturing costs may be high.

The above-mentioned limitations may be solved by changing a circuit pattern in a silicon substrate having actuators formed thereon or manufacturing a customized driving IC appropriate for the 1024 structure.

However, in the former case, since an expensive silicon substrate is manufactured to be relatively large, inkjet print head manufacturing costs increase. Further, in the latter case, since a driving IC is separately manufactured according to a kind of inkjet print head, manufacturing costs also increase.

Third, it is difficult to normally operate a driving IC.

In the inkjet print head having the 1024 structure, since a plurality of actuators are densely integrated, a significant larger amount of heat may be generated as compared to that generated in an inkjet print head having the 512 structure during an ink discharging process. However, when the plurality of actuators and driving ICs are directly connected to each other, the heat generated from the actuator is transferred to the driving IC as it is, such that the driving IC may malfunction in a printing process for a long period of time.

In the present invention, the purpose of which is to solve the above-mentioned problem, a connection structure between an actuator and a driving IC appropriate for a 1024 structure has been developed. More specifically, according to the present invention, the connection structure between the actuator and the driving IC may be improved by disposing a connection substrate between an ink discharging unit and a switching board.

According to the present invention configured as described above, since the actuator and the driving IC are connected to each other by the connection substrate, it is not necessary to increase a size of the ink discharging unit formed of a relatively expensive material.

In addition, according to the present invention, since the actuator and the connection substrate may be connected to each other by a wire, the actuators may be densely disposed.

Further, according to the present invention, since the connection substrate may block heat generated from the ink discharging unit, a phenomenon in which the driving IC malfunctions due to high heat may be significantly reduced.

In addition, according to the present invention, since a space in which the driving IC may be disposed may be secured by the connection substrate, a lifespan of the driving IC may be ensured. Therefore, according to the present invention, a manufacturing cost of the inkjet print head may be reduced.

Hereinafter, embodiments of the present invention will be described in detail with reference to the accompanying drawings.

In describing the present invention below, terms indicating components of the present invention are named in consideration of functions thereof. Therefore, the terms should not be understood as limiting technical components of the present invention.

Figure 2:
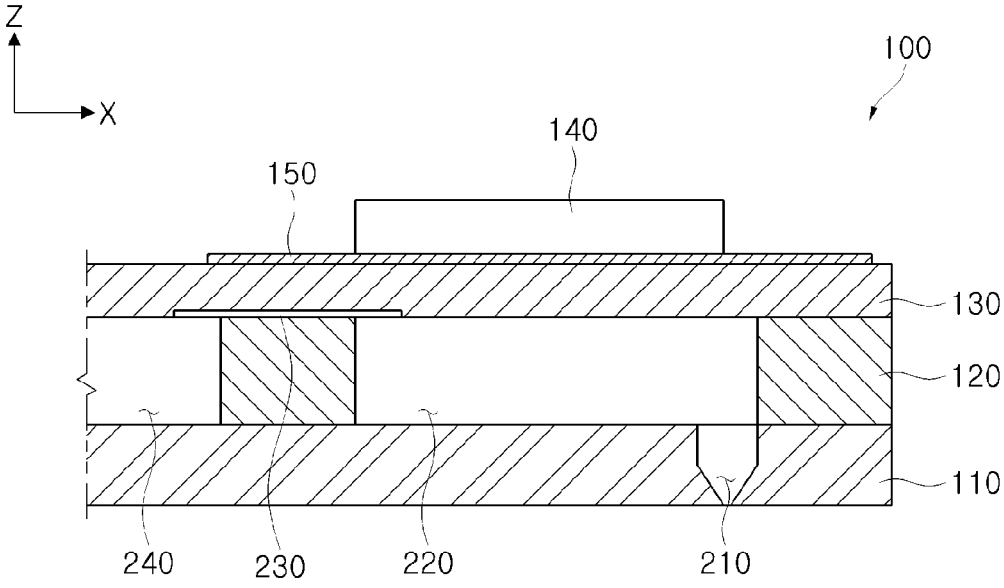
FIG. 2 is an enlarged cross-sectional view of an ink discharging unit shown in FIG. 1.
Figure 3:
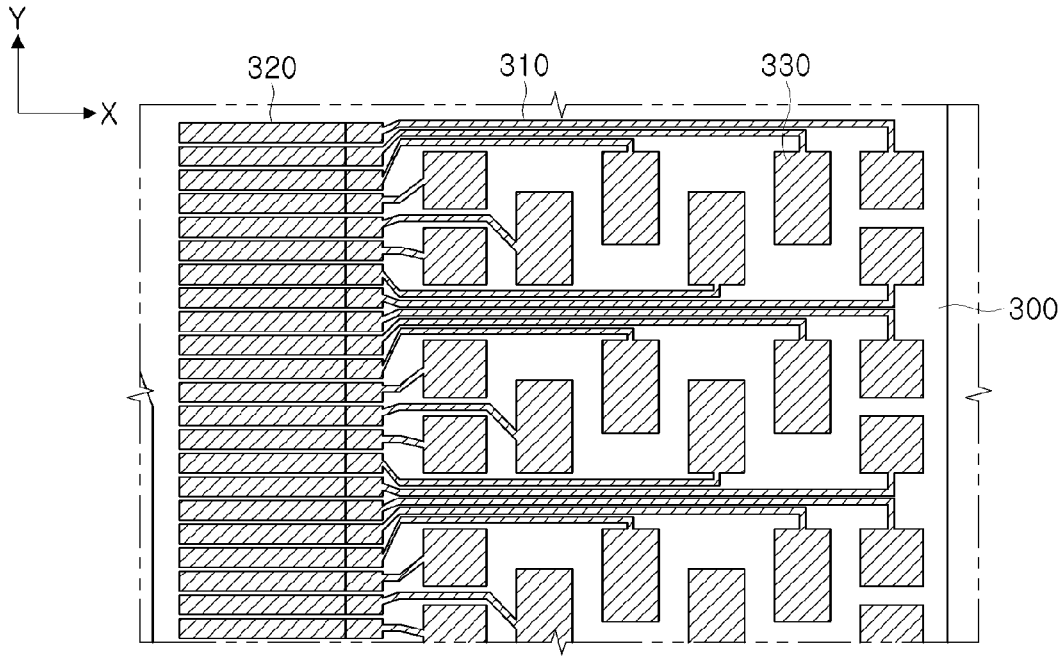
FIG. 3 is a plan view showing an upper surface of a connection substrate contacting a switching board.
Figure 4:
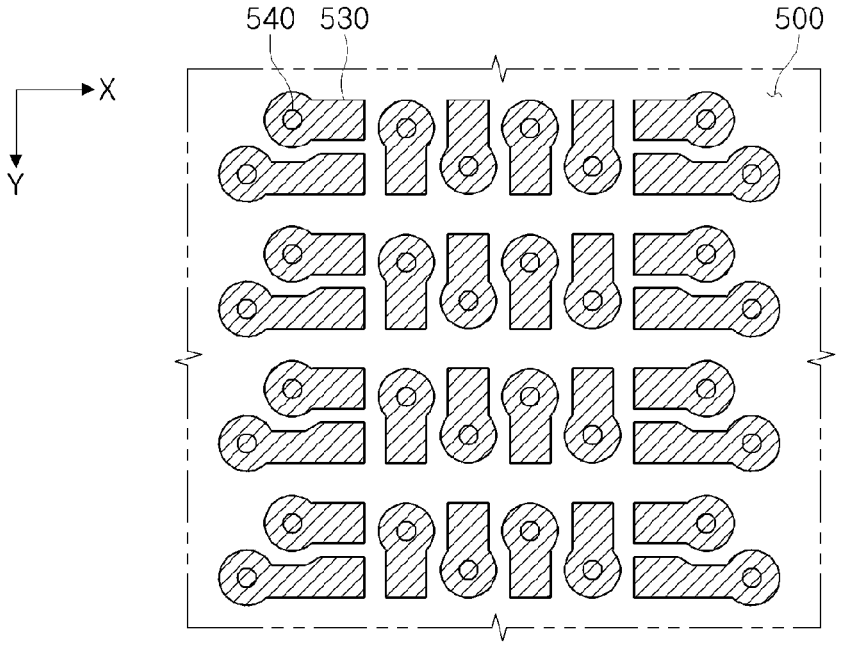
FIG. 4 is a bottom view showing a lower surface of the switching board contacting the connection substrate.
Figure 5:
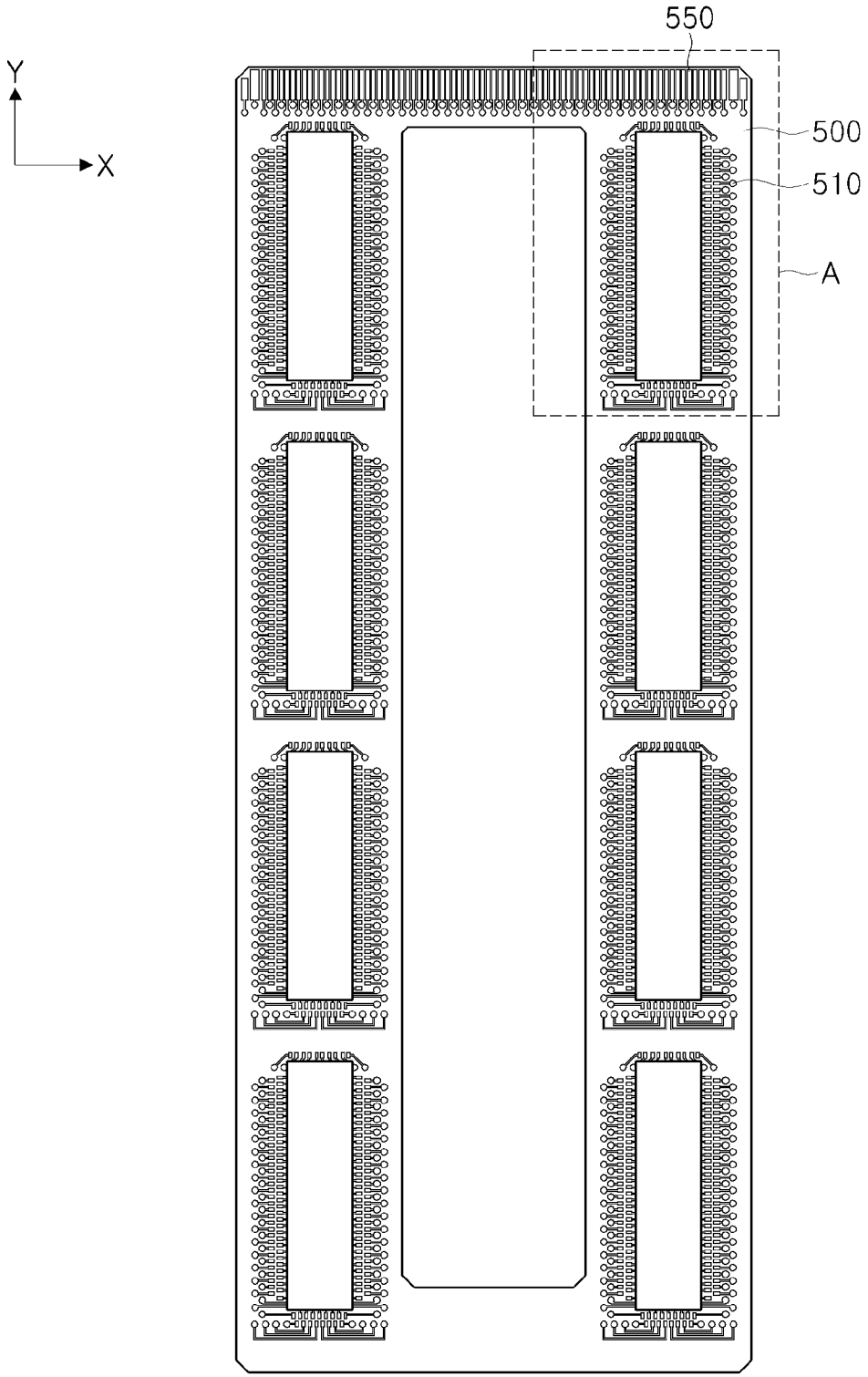
FIG. 5 is a plan view of the switching board in a state in which a driving integrated chip (IC) is removed therefrom.
Figure 6:
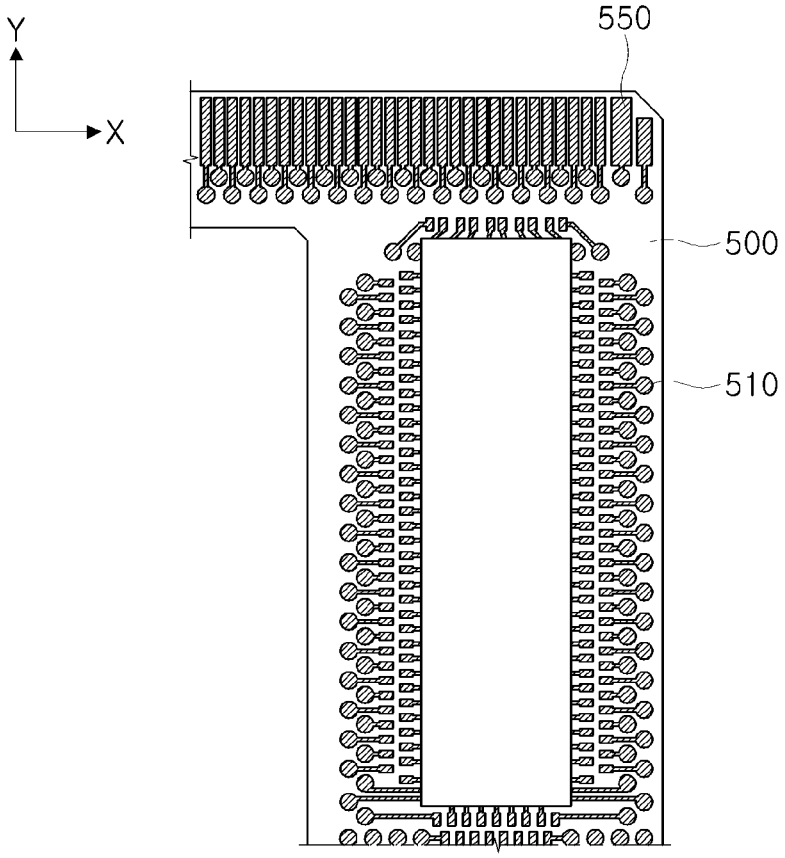
FIG. 6 is an enlarged view of part A of FIG. 5.
Figure 7:
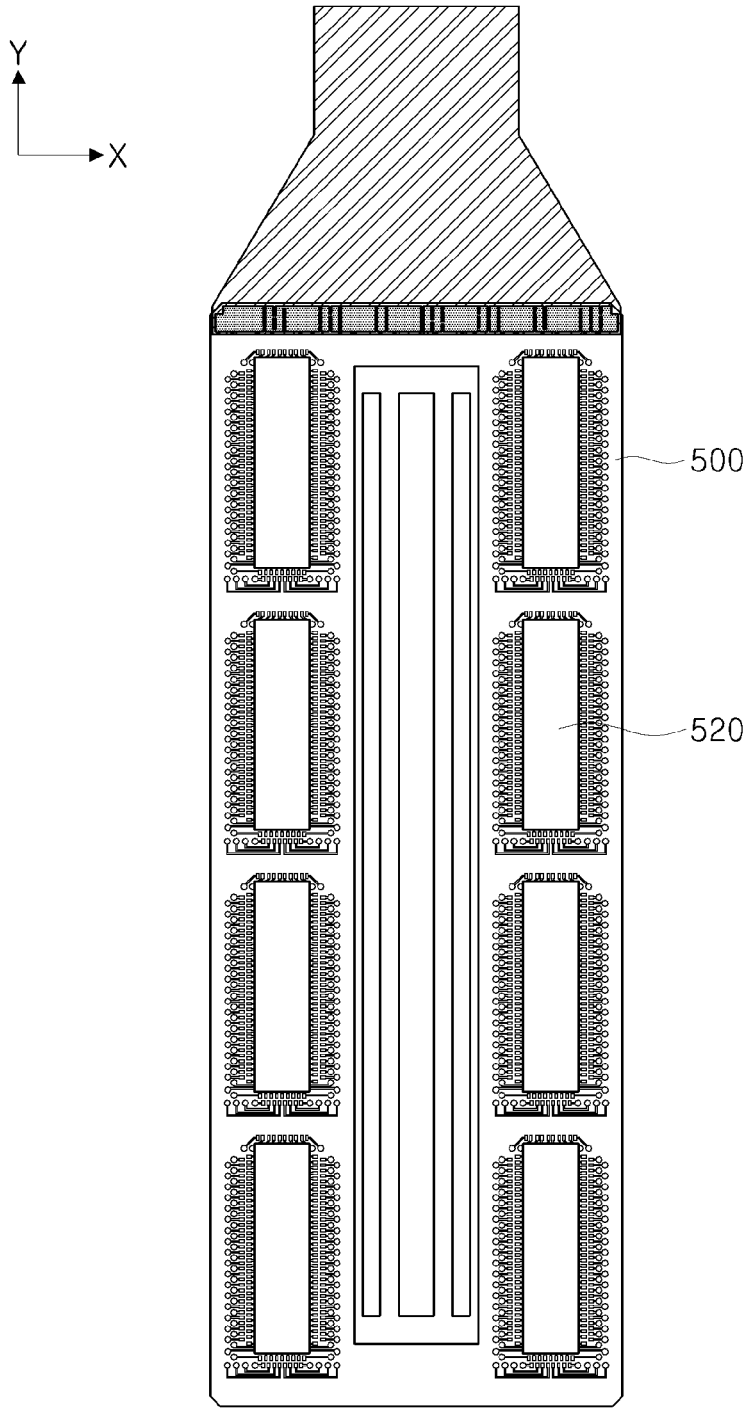
FIG. 7 is a plan view of the switching board in a state in which the driving IC is disposed.
Figure 8:
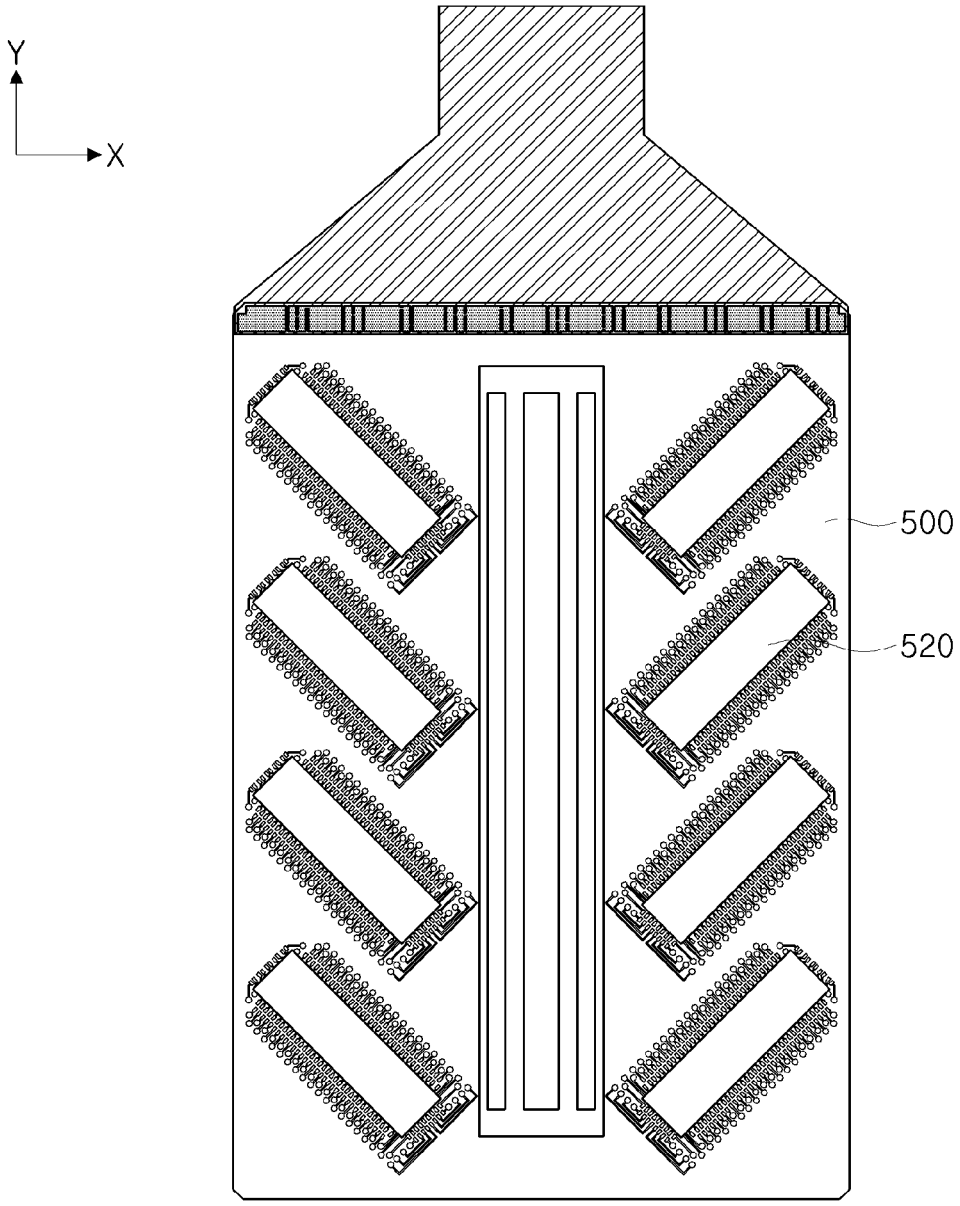
FIG. 8 is a plan view of the switching board in another state in which the driving IC is disposed.
Figure 9:
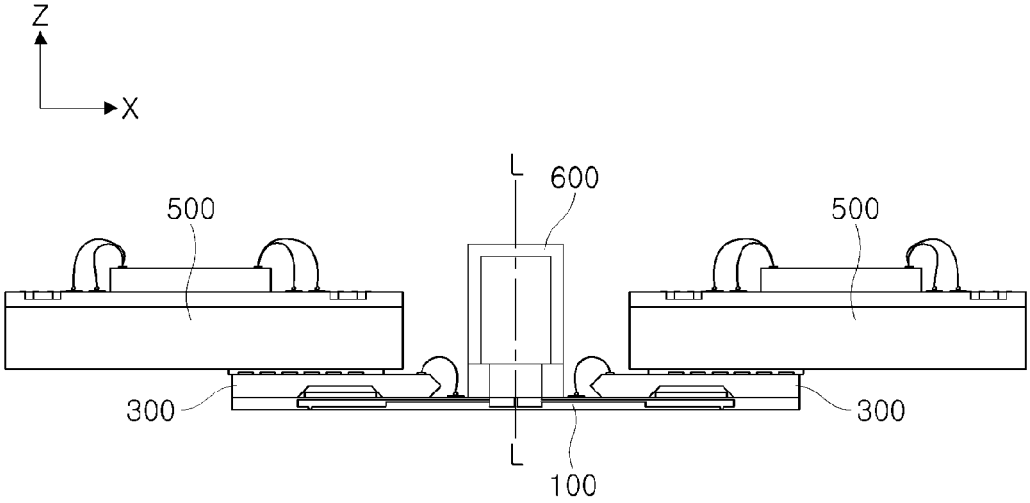
FIG. 9 is a cross-sectional view of an inkjet print head according to another embodiment of the present invention.

FIG. 1 is a cross-sectional view of an inkjet print head according to an embodiment of the present invention. FIG. 2 is an enlarged cross-sectional view of an ink discharging unit shown in FIG. 1. FIG. 3 is a plan view showing an upper surface of a connection substrate contacting a switching board. FIG. 4 is a bottom view showing a lower surface of the switching board contacting the connection substrate. FIG. 5 is a plan view of the switching board in a state in which a driving integrated chip (IC) is removed therefrom. FIG. 6 is an enlarged view of part A of FIG. 5. FIG. 7 is a plan view of the switching board in a state in which the driving IC is disposed. FIG. 8 is a plan view of the switching board in another state in which the driving IC is disposed. FIG. 9 is a cross-sectional view of an inkjet print head according to another embodiment of the present invention.

An inkjet print head according to an embodiment of the present invention will be described with reference to FIGS. 1 to 3.

An inkjet print head 1000 according to the embodiment of the present invention may include an ink discharging unit 100, a connection substrate 300, and a switching board 500.

The ink discharging unit 100 may include a component for discharging ink. To this end, the ink discharging unit 100 may include nozzles 210 discharging ink, pressure chambers 220 temporarily storing the ink therein, and actuators 140 applying pressure to the ink stored in the pressure chambers 220.

The ink discharging unit 100 may further include an oxide layer. More specifically, the oxide layer may be formed on a surface of the ink discharging unit 100. The oxide layer formed as described above may block an electric connection between the ink discharging unit 100 and another member.

The ink discharging unit 100 may include a plurality of substrates. For example, the ink discharging unit 100 may include a first substrate 110, a second substrate 120, and a third substrate 130. Here, the first substrate 110, the second substrate 120, and the third substrate 130 may be sequentially stacked and be formed of single crystalline silicon.

The first substrate 110 may form a lower layer of the ink discharging unit 100. The first substrate 110 may be formed of a single crystalline silicon substrate or a silicon on insulator (SOI) substrate as needed. Alternatively, the first substrate 110 may be a laminated substrate in which a silicon substrate and a plurality of insulating members are laminated.

The first substrate 110 may include a plurality of the nozzles 210. Each of the nozzles 210 may be formed to extend in a thickness direction (a Z axis direction based on FIG. 1) of the first substrate 110.

The nozzles 210 may be formed at predetermined intervals in a length direction (a Y axis direction based on FIG. 1) of the first substrate 110 and formed in multiple rows in a width direction (an X axis direction based on FIG. 1) of the first substrate 110.

Each nozzle 210 may have a cross-sectional area varied in the thickness direction of the first substrate 110. For example, the nozzle 210 may have a cross-sectional area gradually reduced toward a-Z axis, as shown in FIG. 1. However, the shape of the nozzle 210 is only an example and is not limited thereto. That is, the nozzle 210 may have a hole shape in which it has the same cross-sectional size.

The second substrate 120 may form an intermediate layer of the ink discharging unit 100. That is, the second substrate 120 may be stacked on the first substrate 110.

The second substrate 120 may be formed of a single crystalline silicon substrate or an SOI substrate as needed. Alternatively, the second substrate 120 may be a laminated substrate in which a silicon substrate and a plurality of insulating members are laminated.

The second substrate 120 may include the pressure chambers 220 and a manifold 240, and selectively further include restrictors 230.

The pressure chambers 220 may be disposed in the second substrate 120. More specifically, the pressure chambers 220 may be formed to extend in a thickness direction (the Z axis direction) of the second substrate 120.

The pressure chambers 220 may be connected to the nozzles 210 of the first substrate 110. That is, the pressure chambers 220 may be in communication with the nozzles 210 in a state in which the first and second substrates 110 and 120 are coupled to each other.

Each pressure chamber 220 may have a predetermined volume. For example, the pressure chamber 220 may have volume the same as or larger than a single ink discharge amount. Here, the former may be advantageous for fixed quantity discharging of ink, and the latter may be advantageous for continuous discharging of ink.

The pressure chambers 220 formed as described above may be formed at predetermined intervals in a horizontal direction (the X axis direction) and a vertical direction (the Y direction) of the second substrate 120, similar to the nozzles 210.

The manifold 240 may be formed in the second substrate 120. More specifically, the manifold 240 may be formed to be spaced apart from the pressure chambers 220 in the X direction as shown in FIG. 2.

The manifold 240 may be connected to a plurality of the pressure chambers 220. For example, a single manifold 240 may be connected to the plurality of pressure chambers 220 through the restrictors 230 formed to extend in the X axis direction. To this end, the manifold 240 may be formed to extend in a length direction (the Y axis direction) of the second substrate 120.

Unlike this, the manifold 240 may be provided in plural and a plurality of manifolds 240 may be connected to the plurality of pressure chambers 220 in a one-to-one manner. For example, the plurality of manifold 240 may be formed at the same intervals as those of the plurality of pressure chambers 220 in the length direction of the second substrate 120.

In this structure, since the ink is separately supplied to each pressure chamber 220 through the manifold 240, the ink may be stably supplied. Therefore, this structure may be advantageous in achieving high resolution printing quality. Further, in this structure, since an adjacent pressure chamber is not affected by a pressure change (for example, a reverse ink flow phenomenon) generated in any pressure chamber, a cross-talk phenomenon which is a problem of the inkjet print head may be reduced.

The third substrate 130 may form an upper layer of the ink discharging unit 100. That is, among three substrates, the third substrate 130 may be disposed in an uppermost position.

The third substrate 130 may be formed of a single crystalline silicon substrate or a silicon on insulator (SOI) substrate as needed. Alternatively, the third substrate 130 may be a laminated substrate in which a silicon substrate and a plurality of insulating members are laminated.

The third substrate 130 may be formed of at least two substrates. For example, the third substrate 130 may be formed of a substrate in which the restrictors 230 are formed and a substrate vibrated by the actuators 140. However, the third substrate 130 is not necessarily formed of a plurality of substrates.

The restrictors 230 may be formed in the third substrate 130. More specifically, the restrictors 230 may be formed at the same intervals as those of the pressure chambers 220 in a length direction (the Y axis direction) of the third substrate 130.

The restrictors 230 may connect the pressure chambers 220 and the manifold 240 to each other in a state in which the second and third substrates 120 and 130 are coupled to each other and control a flow rate of the ink supplied from the manifold 240 to the pressure chambers 220.

Although the embodiment illustrates that the restrictors 230 are formed in the third substrate 130, the restrictors 230 may be formed in the second substrate 120 as needed.

The actuators 140 may be formed on an upper surface of the third substrate 130. More specifically, the actuators 140 may be formed at positions of the third substrate 130, corresponding to the pressure chambers 220.

Each actuator 140 may include a piezoelectric element and upper and lower electrode members. More specifically, the actuator 140 may be a laminate in which the piezoelectric element is disposed between the upper and lower electrode members.

The lower electrode member may be formed on the upper surface of the third substrate 130. The lower electrode member may be formed of a single conductive metal material or a plurality of conductive metal materials. For example, the lower electrode member may be formed of two metal members made of titanium (Ti) and platinum (Pt).

The piezoelectric element may be formed on the lower electrode member. More specifically, the piezoelectric element may be thinly formed on a surface of the lower electrode member by screen printing, sputtering, or the like. The piezoelectric element may be formed of a piezoelectric material. For example, the piezoelectric element may be formed of a ceramic (for example, lead zirconate titanate (PZT)) material.

The upper electrode member may be formed on an upper surface of the piezoelectric element. The upper electrode member may be formed of any one selected from the group consisting of Pt, Au, Ag, Ni, Ti, Cu, and the like.

The actuator 140 configured as described above may provide driving force for discharging the ink in the pressure chamber 220 while extending and contracting according to an electrical signal.

The ink discharging unit 100 may further include an electrode pattern 150.

The electrode pattern 150 may be formed on the third substrate 130 and may be connected to the electrode members of the actuators 140.

The electrode pattern 150 may be formed to extend in a width direction (an X axis direction based on FIG. 2) of the third substrate 130. More specifically, the electrode pattern 150 may have a length greater than that of the actuator 140.

The electrode pattern 150 formed as described above may be connected to the first circuit pattern 310 of the connection substrate 300 by a wire.

The connection substrate 300 may be formed on the ink discharging unit 100. More specifically, the connection substrate 300 may be stacked on the ink discharging unit 100.

The connection substrate 300 may include a disposition space 302 and a through-hole 304.

The disposition space 302 may be formed in a lower portion of the connection substrate 100. More specifically, the disposition space 302 may be formed to face the actuators 140 in a state in which the ink discharging unit 100 and the connection substrate 300 are coupled to each other.

The disposition space 302 may have a size capable of receiving the actuators 140 therein. For example, the disposition space 302 may be formed to extend in the length direction (the Y axis direction based on FIG. 1) of the inkjet print head so as to receive a plurality of the actuators 140 disposed in a row therein.

The through-hole 304 may be formed to extend in a thickness direction (a Z axis direction based on FIG. 2) of the connection substrate 300. The through-hole 304 may be formed to be spaced apart from the disposition space 302 and may be used as a space into which a wire or a connecting wiring is inserted.

The connection substrate 300 may include the first circuit pattern 310 as shown in FIG. 3.

The first circuit pattern 310 may be formed on the connection substrate 300 and include first and second connection pads 320 and 330.

The first connection pads 320 may be formed at predetermined intervals in a length direction (a Y axis direction based on FIG. 3) of the connection substrate 300. More specifically, the first connection pads 320 may be formed on the connection substrate 300 at the same intervals as those of actuators 140 formed in the ink discharging unit 100. Each first connection pad 320 formed as described above may be connected to each actuator 140 by a wire 400 (See FIG. 1) and the electrode pattern 150.

The second connection pads 330 may be arbitrarily formed in a width direction (an X axis direction based on FIG. 3) of the connection substrate 300. Here, an arrangement interval of the second connection pads 330 may be larger than that of the first connection pads 320. The second connection pads 330 adjacent to each other may have a wide interval therebetween, to thereby be easily connected to other connection pads. For example, the second connection pads 330 may be connected to third connection pads 530 (See FIG. 4) of the switching board 500.

The switching board 500 may be formed on the connection substrate 300. More specifically, the switching board 500 may be disposed so as to contact the second connection pads 330 of the connection substrate 300.

The switching board 500 may fixed to the connection substrate 300. For example, the switching board 500 may be adhered to the connection substrate 300 by an anisotropic conductive film (ACF).

The switching board 500 may include a second circuit pattern 510, driving ICs 520 and the third connection pads 530.

The second circuit pattern 510 may be formed on the switching board 500 as shown in FIGS. 5 and 6. The second circuit pattern 510 may connect the actuators 140 and the driving ICs 520 to each other. In addition, the second circuit pattern 510 may connect the driving ICs 520 and an external terminal 550 to each other.

The driving ICs 520 may be mounted on the switching board 500 as shown in FIG. 7. More specifically, the driving ICs 520 may be mounted at predetermined intervals so as to control a preset group of actuators 140.

Meanwhile, although the driving ICs 520 are disposed in parallel with a length direction (a Y direction based on FIG. 7) of the switching board 500 in FIG. 7, the driving ICs 520 may be obliquely disposed with respect to the length direction as shown in FIG. 8 as needed. For reference, the latter may be advantageous in reducing lengths of the switching board 500 and the inkjet print head 1000.

The third connection pads 530 may be formed on a lower surface of the switching board 500. More specifically, the respective third connection pads 530 may be formed at positions corresponding to those of the second connection pads 330 in a state in which the connection substrate 300 and the switching board 500 are bonded to each other.

The third connection pads 530 may include via electrodes 540. The via electrodes 540 may be formed to extend in the thickness direction (the Z direction based on FIG. 1) of the switching board 500 and connect the third connection pads 530 and the second circuit pattern 510 to each other.

In the inkjet print head 1000 configured as described above, the actuator 140 having a relatively dense electrode pattern and the driving IC 520 having a relatively wide electrode pattern may be easily connected to each other.

In addition, in the inkjet print head 1000 according to the embodiment of the present invention, since the connection substrate 300 may block the heat generated from the ink discharging unit 100, an overheating phenomenon in the switching board 500 may be efficiently prevented.

Further, in the inkjet print head 1000 according to the embodiment of the present invention, since a size of the switching board 500 is not limited, the driving ICs 520 may be easily disposed, and cooling units for cooling the driving ICs 520 may also be disposed. Therefore, the inkjet print head 1000 may be advantageously used for high resolution printing work and high speed printing work.

Meanwhile, in the inkjet print head 1000, the connection substrate 300 and the switching board 500 may be disposed to be symmetrical to each other, based on a bisecting line (L-L) of the ink discharging unit 100 as shown in FIG. 9.

In addition, the inkjet print head 1000 may further include an ink supplying unit 600 formed at the center of the ink discharging unit 100. In this case, the connection substrate 300 may be further provided with a channel connecting the ink supplying unit 600 and the manifold of the ink discharging unit 100.

In the inkjet print head 1000 configured as described above, the ink supplying unit 600 is disposed at an empty space formed between one switching board 500 and the other switching board 500, which is advantageous in miniaturizing the inkjet print head 1000.

As set forth above, according to the embodiments of the present invention, a small-sized inkjet print head capable of achieving high resolution printing quality may be provided.

While the present invention has been shown and described in connection with the embodiments, it will be apparent to those skilled in the art that modifications and variations can be made without departing from the spirit and scope of the invention as defined by the appended claims.

What is claimed is:

1. An inkjet print head comprising:

an ink discharging unit including a plurality of actuators;

a connection substrate disposed on the ink discharging unit and having a first circuit pattern electrically connected to the plurality of actuators;

a switching board having a second circuit pattern connected to the first circuit pattern and including a plurality of driving integrated chips (ICs) controlling the plurality of actuators; and a cooling unit formed in the connection substrate and cooling the switching board.

2. The inkjet print head of claim 1, wherein the plurality of actuators are connected to the first circuit pattern by wires.

3. The inkjet print head of claim 1, wherein the connection substrate includes a plurality of through-holes into which a plurality of wires connecting the plurality of actuators and the first circuit pattern to each other are inserted, respectively.

4. The inkjet print head of claim 1, wherein the connection substrate has a disposition space in which the plurality of actuators are disposed.

5. The inkjet print head of claim 1, wherein the plurality of driving ICs are obliquely disposed with respect to a length direction of the switching board.

6. The inkjet print head of claim 1, wherein the first circuit pattern includes a plurality of first connection pads and a plurality of second connection pads.

7. The inkjet print head of claim 6, wherein the second connection pads adjacent to each other are alternately disposed.

8. The inkjet print head of claim 6, wherein the switching board includes third connection pads connected to the second connection pads.

9. An inkjet print head comprising:

an ink discharging unit including a plurality of actuators arranged in two rows;

a connection substrate disposed on the ink discharging unit and having a first circuit pattern electrically connected to the plurality of actuators;

an ink supplying unit disposed at a center of the connection substrate;

a pair of switching boards having a second circuit pattern connected to the first circuit pattern, including a plurality of driving ICs controlling the plurality of actuators, and disposed to be symmetrical to each other, based on the ink supplying unit; and a cooling unit formed in the connection substrate and cooling the switching board.

10. The inkjet print head of claim 9, wherein the plurality of actuators are connected to the first circuit pattern by wires.

11. The inkjet print head of claim 9, wherein the connection substrate includes a plurality of through-holes into which a plurality of wires connecting the plurality of actuators and the first circuit pattern to each other are inserted, respectively.

12. The inkjet print head of claim 9, wherein the connection substrate has a disposition space in which the plurality of actuators are disposed.

13. The inkjet print head of claim 9, wherein the plurality of driving ICs are obliquely disposed with respect to a length direction of the switching board.

14. The inkjet print head of claim 9, wherein the first circuit pattern includes a plurality of first connection pads and a plurality of second connection pads.

15. The inkjet print head of claim 14, wherein the second connection pads adjacent to each other are alternately disposed.

16. The inkjet print head of claim 14, wherein the switching board includes third connection pads connected to the second connection pads.

* * * * *